US008795408B2

(12) United States Patent
D'Halluin et al.

(10) Patent No.: US 8,795,408 B2
(45) Date of Patent: Aug. 5, 2014

(54) METHOD AND DEVICE FOR CONTROLLING THE INTRODUCTION OF SEVERAL METALS INTO A CAVITY DESIGNED TO MELT SAID METALS

(75) Inventors: Arnaud D'Halluin, Genas (FR); Benjamin Grenier, Saint-Paul-en-Jarez (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 370 days.

(21) Appl. No.: 13/129,432

(22) PCT Filed: Nov. 14, 2008

(86) PCT No.: PCT/FR2008/001607

§ 371 (c)(1),
(2), (4) Date: Jun. 22, 2011

(87) PCT Pub. No.: WO2010/055211

PCT Pub. Date: May 20, 2010

(65) Prior Publication Data

US 2011/0265604 A1 Nov. 3, 2011

(51) Int. Cl.

| | |
|---|---|
| ***C22B 9/16*** | (2006.01) |
| ***B05C 11/00*** | (2006.01) |
| ***B05C 3/12*** | (2006.01) |
| ***B05C 11/11*** | (2006.01) |

(52) U.S. Cl.
USPC ..... 75/384; 75/414; 420/590; 427/431; 427/435; 427/436

(58) Field of Classification Search
CPC ..... C23C 2/00
USPC ..... 75/384, 414; 420/590; 427/431, 435, 427/436
See application file for complete search history.

(56) References Cited

U.S. PATENT DOCUMENTS

| | | | |
|---|---|---|---|
| 5,256,272 | A | 10/1993 | Alcock et al. |
| 5,954,896 | A | 9/1999 | Koyama et al. |
| 2004/0166360 | A1 | 8/2004 | Imai et al. |

FOREIGN PATENT DOCUMENTS

| | | | |
|---|---|---|---|
| CN | 101092681 | A | 12/2007 |
| JP | 61140842 | A | 6/1986 |

(Continued)

OTHER PUBLICATIONS

Al (Aluminum) Binary Alloy Phase Diagrams, Alloy Phase Diagrams, vol. 3, ASM Handbook, ASM International, 1992, p. 2.4-2.56 from http://products.asminternational.org/hbk/index.jsp downloaded on Apr. 18, 2013.*

(Continued)

*Primary Examiner* — George Wyszomierski
*Assistant Examiner* — Tima M McGuthry Banks
(74) *Attorney, Agent, or Firm* — Laurence A. Greenberg; Werner H. Stemer; Ralph E. Locher

(57) ABSTRACT

A method and a device control the introduction of several metals into a cavity configured to melt the metals in the form of ingots. In particular, the method is configured to control the introduction of several metals into a cavity for melting the metals so as to dip-coat a steel strip with the metals in liquid metal form. Whereby a first metal is introduced in the form of at least a first ingot having a high content of the first metal and a second metal is introduced in the form of at least a second ingot formed as an alloy of the first metal and the second metal. The second metal content of the second ingot is chosen from a range of significant contents for ensuring an intended overall flow rate for combined melting of the ingots, the range of significant contents being chosen in a limited interval of sequentially increasing values so as to minimize differences between melting points of the ingots.

8 Claims, 1 Drawing Sheet

(56) References Cited

FOREIGN PATENT DOCUMENTS

| | | | |
|---|---|---|---|
| JP | 5186857 | A | 7/1993 |
| JP | 10183320 | A | 7/1998 |
| KR | 20040057746 | A | 7/2004 |
| RU | 2093602 | C1 | 10/1997 |
| WO | 9318198 | A1 | 9/1993 |
| WO | 03035922 | A1 | 5/2003 |
| WO | 2007137665 | A2 | 12/2007 |
| WO | 2008105079 | A1 | 9/2008 |

OTHER PUBLICATIONS

Machine translation of JP 07-180016 A, published Jul. 18, 1995.*
Machine translation of JP 05-186857 A, published Jul. 27, 1993.*
Machine translation of KR 20040057746 A, published Jul. 2, 2004.*

* cited by examiner

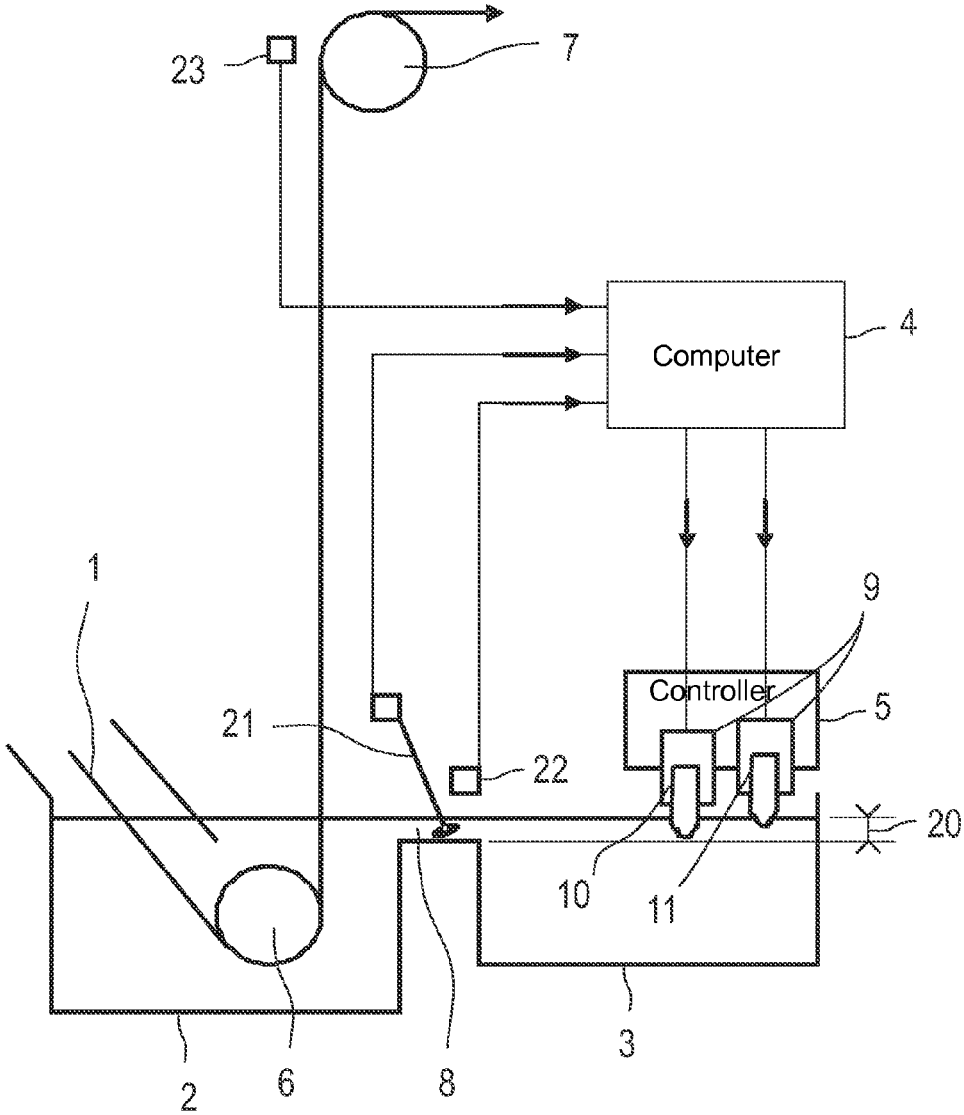
23
7
Computer
4
1
9
Controller
5
21
22
20
10
11
3
2
6
8

METHOD AND DEVICE FOR CONTROLLING THE INTRODUCTION OF SEVERAL METALS INTO A CAVITY DESIGNED TO MELT SAID METALS

BACKGROUND OF THE INVENTION

Field of the Invention

The present invention relates to a method and a device for controlling the introduction of a plurality of metals into a cavity designed to melt the metals.

The invention relates primarily to the metal dip coating of rolled steel strips in a continuous line, and in particular to the control of the chemical analysis of the coating.

Metal dip coating of rolled steel strips in a continuous line is a known technique basically consisting of two variants, in one of which the strip exiting an annealing furnace descends obliquely into a bath of molten coating metal and is deflected vertically upward by a submerged roll in said molten metal. The other variant involves deflecting the strip vertically upward as it exits the furnace and then causing it to move through a vertical channel containing the magnetically levitated molten metal.

In both cases, the object of the operation is to deposit a continuous and adherent metal coating on the steel strip surface.

As it leaves the molten metal, the strip carries on both of its sides a molten film which is wiped by electromagnetic or gas jet devices until it is reduced to the desired thickness. The wiped molten film is then cooled until it solidifies. The consumption of coating metal deposited on both sides of the strip is compensated by adding ingots to the molten metal bath. In a known manner, these ingots are brought to the molten bath by chain conveying equipment and are charged into the bath of molten metal manually or automatically at a given instruction based on a bath level measurement. Devices of varying sophistication, such as that described in WO2007137665, have been proposed in order to make the introduction of the ingots into the bath more precise, in particular to prevent them from dropping abruptly.

The metal coatings, such as those used, for example, in galvanizing, generally employ an alloy of at least two different metals such as zinc and aluminum. Depending on the grade of alloy to be deposited on the strip, it is necessary to supply the coating bath with ingots of suitable composition. This can be done by supplying ingots of a particular grade, but in general ingots of standard composition are used (e.g. some without alloying material and others with a relatively high percentage of alloying material) which are introduced alternately in a sequence designed to ensure, on average, the required grade on the strip. Document KR20020053126 describes such an ingot charging system based on a daily consumption calculation.

However, depending on the type of coating applied, the intended quantity of alloying material in the coating may be different from that actually consumed. This applies particularly to galvanizing with zinc alloyed with aluminum. In fact, contact with the molten mixture causes the iron in the steel strip to dissolve, this process on the one hand contributing to the formation on the strip surface of an approximately 0.1 μ compound layer of $Fe_2Al_5Zn_x$ and, on the other hand, diffusing into the bath of molten mixture unless the $Fe_2Al_5Zn_x$ layer is formed in a continuous manner. The $Fe_2Al_5Zn_x$ layer serves as a base for the protective zinc layer whereas the dissolved iron will contribute to the formation in the molten mixture of deposits of Fe, Al and Zn known as dross. On the other hand, the steel elements submerged in the bath, such as a stainless steel bottom roll and its support arms, are also subject to dissolution of iron in the bath, which also contributes to dross formation. As the aluminum component of these compounds is greater than that of the alloy layer deposited, the total aluminum consumption is slightly higher than that which would be strictly necessary for applying an alloy layer to both sides of the strip. The necessary aluminum content must therefore be determined from the sum of the aluminum consumptions in the coating, in the $Fe_2Al_5Zn_x$ layer formed on the strip surface and in the dross.

However, numerous factors such as the immersion time (i.e. other things being equal, the line speed), the bath temperature, the quantity of dross formed, etc. are responsible for more or less significant variations in aluminum consumption for the same intended content in the coating.

The ingot charging systems based solely on the theoretical consumption of alloying materials in the coating layer are therefore inadequate and, on the other hand, the estimates of additional consumption in the compound layers and dross remain imprecise, as they are based on steady-state installation operating data and theoretical $Fe_2Al_5Zn_x$ formation kinetics under steady-state operating conditions. In the majority of cases, ingot charging is based on operator experience, backed up by regular chemical analysis of samples taken from the molten bath. Certain continuous measuring techniques based on electrochemical sensors such as that described in document U.S. Pat. No. 5,256,272 are also applied, despite the fragility and unreliability of these measuring instruments.

However, some refinements have been proposed with a view to improving this situation. For example, document KR20040057746 suggests directly measuring the aluminum content of the bath "at regular intervals" in order to control a charging rate of ingots containing 20% aluminum alternating with pure zinc ingots. However, this alternative remains imperfect, as the discontinuous measurement of the aluminum content combined with the response time necessary for the introduction, as a function of the measurement results, and melting of ingots with or without 20% aluminum, apart from being difficult to manage over a long period, does not make the method any more accurate than the theoretical calculation.

An alternative for better continuous adjustment of the content in respect of zinc as the primary coating metal and particularly that in respect of aluminum as the second alloyed metal is described by a plurality of devices in WO2008/105079. A first device has two separate tanks containing zinc and aluminum respectively in molten form, i.e. each of the molten temperatures of which is above the melting point of zinc and aluminum, i.e. 420° C. for zinc and ~660° C. for aluminum. These two molten metals are then introduced into the coating vessel (having a temperature of approximately 460° C.) where, because of the significant temperature differences and gradients between the molten metals and the coating bath, large amounts of dross are inevitably formed. A second device is provided for introducing zinc and aluminum in the form of solid strip metals which are paid out into the coating bath, their speeds and contents being controlled according to required contents and bath level. Once again, temperature gradients are inevitable, as it is necessary in any case to heat at least the pure aluminum to a temperature of at least ~660° C. just before adding it to the coating bath so that it can mix into the bath in molten form. Finally, a third device provides that the two separate tanks containing respectively molten zinc and aluminum are poured into an intermediate tank where a large amount of dross is formed because of excessive temperature gradients. Although this device has the advantage of enabling the coating bath to be isolated from the dross in the intermediate bath, the latter requires frequent emptying because of the heavy dross formation. Generally speaking, these devices therefore suffer from the presence of excessively steep temperature gradients conducive to an equally heavy formation of troublesome dross and therefore inevitably substantial losses of usable metal for strip coating. This drawback therefore imposes needless additional costs of overconsumption of metals usable for coating as well as highly restrictive environmental aspects for large-scale reprocessing of the dross formed.

BRIEF SUMMARY OF THE INVENTION

Accordingly, the present invention shuns methods or devices involving steep temperature gradients and shall be based on the usage of metal or metal alloy ingots to be melted.

Thus, one object of the present invention is to propose a method and a device for controlling the introduction of a plurality of metals in the form of ingots into a cavity designed to melt said metals, wherein temperature gradients of the metals introduced and of the contents of the cavity are minimal.

Advantages of the invention are also set forth in a number of sub-claims.

Based on a method for controlling the introduction of a plurality of metals into a cavity designed to melt said metals in order to dip-coat a steel strip with said metals in the form of molten metal, wherein

- a first metal is introduced in the form of at least one first ingot with a high content of said first metal,
- a second metal is introduced in the form of at least one second ingot consisting of an alloy of the first metal and the second metal, the method according to the invention provides that:

- the second metal content of the second ingot is selected from a range of significant contents for ensuring an intended overall rate of combined melting of the ingots,
- the range of significant contents is selected from a limited span of sequentially increasing values so as to minimize differences between melting points of the ingots.

The cavity is here a conventional or magnetically levitated coating pot, or a vessel for melting said ingots which is ancillary to the coating pot. In the context of a steel strip galvanizing line for which the control method according to the invention is installed, the first metal is zinc and the second metal is mainly aluminum. However, the present invention is not limited to these two metals and to alloys of these individual metals depending on the type of coating selected. Much more important is the fact that, on the one hand, by using alloy ingots where e.g. one of the two metals would have required a high melting point, the overall melting point of the ingot remains lower thanks to the presence of the other alloying metal.

In addition, if the range of significant contents is selected as described above, it is possible to have a homogeneous and continuous spread of ingot melting points within this content range, even if one or more ingots are dipped into or withdrawn from the cavity, thereby advantageously avoiding steep temperature gradients when the ingots are introduced into the cavity.

Analogously to the second ingot, at least one third ingot of the same type of alloy as the second ingot and having a significant content of the second or another metal may of course be introduced into the cavity, its content being different from that of the second ingot within the adopted range of significant contents. Similarly, a plurality of separate significant content ranges can be provided in order to be able to obtain a greater content variation dynamic if necessary. If large differences between the contents of a plurality of ranges are required, it is possible to tier these ranges by using at least one ingot having an intermediate content between these ranges. Once again, because of the content differences thus reduced, any sudden variation in the required melting point will be advantageously absorbed.

Taking account of differences between required melting points of one of the ingots in the form of an alloy of at least the first and the second metal and an imposed temperature of the bath in the cavity, second metal content spans are ideally centered, in the ranges according to the invention, around at least one eutectic point of a phase diagram of said ingot (said diagram representing the melting point of the alloy of each ingot as a function of the percentages of the alloying metals of said ingot). In fact, particularly in the vicinity of the eutectic point, the alloy firstly exhibits a minimum required melting point below that of each of its constituent metals and therefore much closer to the bath temperature. It is therefore possible to minimize the temperature differences while being able to modify the significant content ranges within a limited span centered on the eutectic point. To this end, ingots corresponding to these sequentially increasing content ranges are introduced into or withdrawn from the bath. Obviously, this ideal selection of ingots is intended to be permanent within the scope of the invention, but the invention can also provide that ingots within significant second metal content ranges farther away from the limited content span (and therefore from the eutectic point) shall be introduced in a temporary manner.

As an example of dip galvanizing of a steel strip, the first metal is zinc Zn and the second metal is aluminum Al and the significant content range is selected from aluminum content spans around the eutectic point of the phase diagram of the Zn—Al alloy: corresponds to a minimum melting point for a Zn—Al alloy (for example: 4.5% of Al permitting a melting point from 390° C.).

Ingot types of various contents used for the main types of galvanizing such as for a Zn—Al alloy of this kind are known and can be graded in this way according to the significant content ranges as envisaged by the invention.

By way of example, for conventional galvanization, a range designated "GI" specifies an aluminum content in a span of [0; 1%] (or more probably [0; 10%]). This corresponds to ASTM standard B852-07 for which significant content ranges can be selected by specifying ingots having an aluminum content of 0.25, 0.35, 0.45, 0.55, 0.65, 0.75 or 1%. In the case of additional and one-off aluminum requirement, it is possible to extend the preceding range by means of additional ingots of higher content and compliant with another standard such as "ASTM 6860-07" having 4, 5, or 10% aluminum or, conversely, to use a pure zinc ingot.

Other types of galvanization subject to predefined standards specify lower added aluminum content (range designated "GA" specifying an aluminum content in a span of [0; 1%]) and the invention can provide for significant content ranges within limited spans meeting other standards such as "ASTM B852-07". In this case, the invention can provide that at least one of the ingots can comprise pure zinc, such as an ingot known under the ASTM standard.

Some alloys, e.g. marketed under the GALFAN® brand, also have higher aluminum content spans [4.2-6.2%] (and sometimes [0; 10%]) which may be potentially usable within the scope of the invention to define higher significant content ranges than usual contents, while remaining in a limited region close to the eutectic point of the Zn—Al phase diagram.

To summarize for this example, if the first metal is zinc and the second metal aluminum, the significant content range is selected predominantly from aluminum content spans of [0, 10%] and to a lesser extent from higher content spans.

A significant content range may therefore be advantageously selected from at least one span of content values associated with limited variations in the melting point of the phase diagram of an ingot alloy, ideally by selecting the values of said spans in a staggered manner in the vicinity of the eutectic point of the ingot alloy lending itself adequately to the object of the invention.

The method according to the invention also provides that:

- active introduction of the first and of at least one of the seconds ingots (alloys) is controlled as a function of a measurement of each content of the metals, finally molten, in the cavity and/or solid on the coated strip,
- in order to select which of the second ingots to introduce, at least one second metal content of the second ingot is, on the one hand, selected from the range of significant contents for ensuring an intended overall rate of combined melting of the ingots in order to maintain a constant level of molten metal in the cavity,
- on the other hand, an actual overall rate of combined melting of the ingots in the cavity is measured and correlated with the measured contents of each metal in the cavity in order to determine an actual partial rate for each ingot,
- in the event of a difference between the actual overall rate and the intended overall rate, at least one of the actual partial rates of each ingot is readjusted to compensate for this difference by modifying an immersed height of introduction of at least one of the ingots into the cavity.

Very fine regulation of the melting of the ingots can therefore be obtained, again without involving successive introductions of ingots with abrupt melt flows and/or excessively far-apart partial contents.

Said correlation of the actual overall rate of combined melting of the ingots with the measured contents of each metal is carried out by establishing a partial rate of melting of each of the ingots simultaneously introduced so as to preserve an equality of equilibrium (A) such that:

$$Al\%x*Qx=[(Al\%1*Q1)+\ldots+(Al\%n*Qn)] \quad (A)$$

comprising an intended content of second metal (Al%x) in the molten coating and a respective content of second metal (Al%1, . . . , Al%n) of each of a plurality (n) of second ingots, said respective content being within the significant content range, and the overall flow (Qx) of new molten metal required for keeping the molten metal level constant in the cavity, said intended overall flow (Qx) being also compensated by the sum of partial simultaneous melt flows (Q1, . . . , Qn) of the plurality (n) of second ingots.

In the same way as the second metal, at least one third metal can also be introduced into the cavity in the form of an ingot alloy compound of the second or third ingot type quoted above. The above equality can thus be applied to this third metal taking into account the partial flows/contents of said third metal. The same would apply to any other added metal of the second metal type, such as the aluminum mentioned above. Likewise, in the same way as the first metal, at least one additional metal can be introduced into the cavity in the form of an ingot having a high content of said additional metal.

The invention thus proposes a device for implementing the method described above. This device will now be described in greater detail with the aid of an exemplary embodiment and with reference to the accompanying drawing:

BRIEF DESCRIPTION OF THE SEVERAL VIEWS OF THE DRAWING

FIG. 1: Device according to the invention for controlling the introduction of a plurality of metals into a cavity designed to melt said metals

DESCRIPTION OF THE INVENTION

FIG. 1 thus shows a device for implementing the described method for controlling the introduction of a plurality of metals (Zn, Al, . . . ) in the form of ingots (10, 11) into a cavity (2, 3) designed to melt said metals in order to dip-coat a steel strip (1) with said metals in the form of molten metal, wherein the cavity is a conventional coating pot (2) (comprising e.g. an intra-cavity strip-deflecting bottom roll (6) and then a vertical deflection supporting roll (7) above the cavity) or a magnetically levitated pot, or an auxiliary pot (3) for melting said ingots which is connected via a runner (8) to a coating tank (2), and comprising:

- a measuring device (21) for measuring the level (20) of molten metal resulting from the melting of the ingots in the cavity,
- at least one measuring device (22, 23) for measuring the contents of the metals resulting from melting of the ingots,
- a computer (4) receiving level and content measurement values from said measuring devices (21, 22, 23) providing actual overall and partial melt flows according to each metal, and adapting said actual values to corrected values according to a predefined equality of equilibrium,
- a controller (5) which is supplied with corrected melt flow values and issues correction instructions,
- a device (9) for varying the introduction height of at least one and therefore each of the ingots into the cavity where melting occurs, said variation device being controlled by correction instructions from the controller and the introduction or withdrawal of the ingots taking place on condition that the metals of the ingots remain within a selected range of significant contents such as that described above in connection with the method according to the invention.

The ingots are therefore placed and moved by the variation device (9) in correlation with the significant content ranges in order to avoid any ingot melting point difference.

The equality of equilibrium (A) can therefore be taken into account in the controller (5) which, depending on the correction instruction, defines an appropriate sequence for introducing one or more ingots in accordance with the conditions imposed by a range selected from a limited span of sequentially increasing values so as to minimize differences between melting points of the ingots.

The content measuring device (22, 23) can comprise a LIBS type laser spectrometer (=Laser Induced Breakdown Spectroscopy) or at least one electrochemical sensor designed to measure one of the metals involved. It is possible to place at least one of these measuring devices at the level of the molten metal (case 22) and/or at the level of the coated strip (case 23) depending on the content characteristics of the molten mixture or of the final desired coating properties. The device (21) for measuring the level (20) is possibly a float on the molten metal surface e.g. at the level of the runner for transferring molten metal from the auxiliary melting pot (3)

to the coating pot (2), a radar or an optical means for measuring the level of said molten metal surface.

The invention claimed is:

1. A method for controlling an introduction of a plurality of metals into a cavity configured to melt the metals for dip-coating a steel strip with the metals in a form of molten metal, which comprises the steps of:

introducing a first metal in a form of at least one first alloy ingot having a content of the first metal; and introducing a second metal in a form of at least one second ingot formed as an alloy of the first metal and the second metal, a second metal percentage content of the second ingot being selected from a range of significant contents for ensuring an intended overall rate of combined melting of the first and second ingots to form a combined ingot, the range of significant contents being selected from within a limited span of sequentially increasing values at or near a eutectic point of the combined ingot so as to minimize differences between melting points of the first and second ingots and impart minimal temperature gradients of the metals introduced into the cavity.

2. The method according to claim 1, which further comprises introducing at least one third ingot of a type of alloy of the second ingot and having a second metal content different from that of the second ingot into the cavity.

3. The method according to claim 1, which further comprises:

controlling an active introduction of the first and of the at least one second ingots in dependence on a measurement of each content of the metals, finally molten, in the cavity and/or solid on a coated strip;

selecting the second ingot, for introduction of at least one second metal percentage content of the second ingot that is selected from the range of significant contents at or near the eutectic point of the combined ingots for ensuring the intended overall rate of combined melting of the ingots to maintain a constant level of molten metal in the cavity: measuring an actual overall rate of combined melting of the ingots in the cavity and correlating with measured contents of each metal in the cavity in order to determine an actual partial rate of each ingot; and optionally, readjusting at least one of actual partial rates of each ingot introduction to compensate for a difference by modifying an immersed height of introduction of at least one of the ingots into the cavity if the actual overall rate and the intended overall rate are different.

4. The method according to claim 1, which further comprises establishing a partial rate of melting of each of the first alloy ingot and second alloy ingot being simultaneously introduced so as to preserve equality such that:

$$Al\%x*Qx=[(Al\%1*Q1)\ldots+(Al\%n*Qn)]$$

containing an intended content of the second metal Al%x in a molten coating and a respective content of the second metal Al%1, . . . , Al%n of each of a plurality n of second ingots, the respective content being within the range of significant contents, and an intended overall flow Qx of new molten metal required for keeping a molten metal level constant in the cavity, the intended overall flow Qx being also compensated by a sum of partial simultaneous melt flows Q1, . . . , Qn of the plurality n of second ingots.

5. The method according to claim 1, which further comprises, in a same way as the second metal, introducing at least one third metal into the cavity in a form of an ingot alloy compound.

6. The method according to claim 1, which further comprises, in a same way as the first metal, introducing at least one additional metal into the cavity in a form an ingot having a content of the additional metal.

7. The method according to claim 1, wherein the significant content range is selected from at least one span of content values associated with limited variations in a melting point of a phase diagram of an ingot alloy, by choosing values of spans in a staggered manner in a vicinity of at least one eutectic point of the ingot alloy.

8. The method according to claim 1, wherein the first metal is zinc and the second metal is aluminum and the significant range of contents is selected from aluminum content spans within [0.25% ; 1%].

* * * * *